US007226031B1

(12) United States Patent
Warner

(10) Patent No.: US 7,226,031 B1
(45) Date of Patent: Jun. 5, 2007

(54) COLLAPSIBLE BOOKSTAND

(76) Inventor: James Richard Warner, 1530 Turf Dr., Henderson, NV (US) 89015

( * ) Notice: Subject to any disclaimer, the term of this patent is extended or adjusted under 35 U.S.C. 154(b) by 0 days.

(21) Appl. No.: 10/796,714

(22) Filed: Mar. 9, 2004

(51) Int. Cl.
*A47G 1/24* (2006.01)

(52) U.S. Cl. ..... 248/457; 248/441.1; 248/460

(58) Field of Classification Search ..... 248/441.1, 248/445, 454, 455, 457, 97, 99, 460
See application file for complete search history.

(56) References Cited

U.S. PATENT DOCUMENTS

| | | | | | |
|---|---|---|---|---|---|
| 260,688 | A | | 6/1882 | Van Kirk | |
| 308,535 | A | | 11/1884 | Vail | |
| 391,608 | A | * | 10/1888 | Hartwell | 248/449 |
| 1,421,595 | A | * | 7/1922 | Smith | 248/27.8 |
| 1,581,742 | A | | 4/1926 | Johnson | |
| 2,972,933 | A | | 3/1961 | Howell | |
| 3,145,014 | A | | 8/1964 | Neuwirth | |
| 4,041,626 | A | * | 8/1977 | Ellis et al. | 40/518 |
| 4,318,527 | A | | 3/1982 | Smith | |
| 4,553,728 | A | | 11/1985 | Corsello | |
| 4,826,125 | A | | 5/1989 | Kelley | |
| 4,880,327 | A | | 11/1989 | Sanabria | |
| 4,886,231 | A | | 12/1989 | Doerksen | |
| 5,383,634 | A | * | 1/1995 | Liao | 248/166 |
| 5,413,394 | A | * | 5/1995 | Mitchell | 294/1.1 |
| 5,497,971 | A | | 3/1996 | Spiro | |
| 5,718,400 | A | * | 2/1998 | Dwy | 248/99 |
| 5,738,315 | A | * | 4/1998 | Kent, Jr. | 248/97 |
| 5,918,907 | A | * | 7/1999 | Ho | 281/45 |
| D422,417 | S | * | 4/2000 | Walters-Dowding et al. | D6/313 |

* cited by examiner

*Primary Examiner*—Carl D. Friedman
*Assistant Examiner*—Tan Le

(57) ABSTRACT

A portable, collapsible, stable bookstand (10) to retain reading or study materials in a reclined position is described. The bookstand (10) is formed from a rotational hollow cylindrical shape (11) adjoining two book supporting arms (12) and a rear supporting arm (13). The rotational hollow cylindrical shape allows for the center supporting arm (13) to rotate outwardly from the two outside supporting arms (12) to place the bookstand (10) in an open position. Once in an open position the reading or study material is firmly reclined against the two outside arms supporting the reading material at the bottom by two curved ends of the book supporting arms (12).

1 Claim, 4 Drawing Sheets

COLLAPSIBLE BOOKSTAND

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

This invention relates to light weight, portable, collapsible bookstands, specifically to materials that need to be positioned at an angle to assist the reader to study or read literature.

2. Background of the Invention

This invention is a light weight, portable, collapsible bookstand. Such bookstands have been used by typists and students to facilitate the ease of viewing diagrams or written materials.

To date there has been a number of attempts to provide a remedy for the individual to support study materials in a manner to facilitate easy, comfortable, and portable accoutrements to meet this need. All attempts have produced products with limited success. The majority of known bookstands have several intricate and complicated parts. In order to be commercially viable and to meet the needs of the student or public a bookstand must be engineered with few movable parts, durable, and have the ability to support heavy books and be used for a variety of reading materials. In addition, to meet the need of the user the bookstand must be designed as a one piece unit to avoid the loss of parts. Whereas, most bookstands are designed with several pieces that require assembly before and after use. A bookstand requiring assembly creates the possibility that pieces will be lost preventing the use of the bookstand. The small number of collapsible and portable bookstands that are presently in the marketplace fail to meet the needs of the general public. The bookstands are impractical due to their size and do not support large books in a stable setting.

There is a need for a collapsible, light weight, stable and portable bookstand. In addition, a bookstand must be designed so the reader can view the supported material in comfort when in a seated position.

Inventors have created several types of bookstands to hold reading materials in an open position for study. Several types of collapsible, portable bookstands have been proposed for-example, U.S. Pat. No. 5,497,971 to Spiro (1996) discloses a complex trigonal pyramidal bookstand consisting of more than twelve different parts and require assembly prior and after use. Additional bookstands in this area have been invented to provide support for larger texts, such as, U.S. Pat. No. 308,535 to Vail (1884), U.S. Pat. No. 1,581,742 to Johnson (1926), U.S. Pat. No. 2,973,933 to Howell (1961), U.S. Pat. No. 4,553,728 to Corsello (1985), Although these bookstands are capable of supporting an average book, the pyramid design fails to provide upper support for an average college text or other heavier books, thus when a book is placed on the bookstand it is not stable and if bumped the book could be knocked off the stand. Many bookstand designs that have the pyramid shape will not hold a book if the majority of a large text was open to one side resulting in a book rolling off the stand due to the lack of back support. In addition, these bookstands are expensive to manufacture and are complex in design.

Historically, inventors have attempted to provide a bookstand that is collapsible, light weight, portable in the collapsed position and consumes as little area as possible during use. U.S. Pat. No. 4,880,327 to Sanabria (1989) and U.S. Pat. No. 4,318,527 to Smith (1980) are examples that have failed to meet these needs. These bookstands and others known are bulky and are difficult to use in small confined areas. The totality of all the designs known fail to accomplish the goals of a comprehensive portable, collapsible bookstand. Below is a list of one or more disadvantages that known bookstands suffer from;

(a) Their engineering is complex, thus expensive to manufacture.

(b) The present designs require the user to assemble the structure prior to use and then dismantle the bookstand after use.

(c) Many of the known bookstands have small parts, thus losing a piece may result in the stand being inoperative.

(d) The bookstands that have a high center of gravity may result in the reading material becoming unstable.

(e) Collapsible designs known are not space efficient when users have limited surface area, such as, libraries or desk cubicles, and coffee shops.

(f) Although, many designs are collapsible, when in the collapsed position they are bulky and require two hands or fully occupy one hand to carry the stand.

(g) A majority of the bookstands have a pyramid configuration, thus fail to support the upper section of a large text.

OBJECTS AND ADVANTAGES

Accordingly, besides the objects and advantages of the collapsible and portability of my bookstand, several objects and advantages of the present invention are:

(a) to provide a bookstand that is simple in design and engineered to be cost efficient to produce;

(b) to not require construction prior and after use;

(c) to engineer the bookstand as an all-inclusive machine with only the necessary amount of parts, permanently attached to avoid the loss of pieces;

(d) to provide a stable stand for all types of text and reading material, using the weight of the reading material for increased stability;

(e) to design a space efficient bookstand that can be used in a confined area;

(f) to design a collapsible bookstand that is thin, compared to the average text when collapsed. In addition, the bookstand is easily carried in one hand or tucked in the binder of a book;

(g) to create a bookstand that will provide upper support for large texts.

Further objects and advantages are to provide a bookstand which can be used easily and conveniently to open and close, without the user having to adjust the stand after and before use, which will not damage the reading material. Still, further objects and advantages will become apparent after consideration of the ensuing description and drawings.

SUMMARY

In accordance with the present invention a bookstand designed to be collapsible and portable, with a stable "M" shaped frame. The bookstand folds to a faction of an average text, thus making the bookstand easily transportable. In addition, the bottom frame of the bookstand securely supports the lower edge of reading material with curved gripping supports. The bookstand's upper support has a larger area for reading material when placed in the recline position for study, thus increasing stability.

DRAWINGS—FIGURES

There are four drawings—figures.

DRAWINGS—REFERENCE NUMERALS

Figure 1:
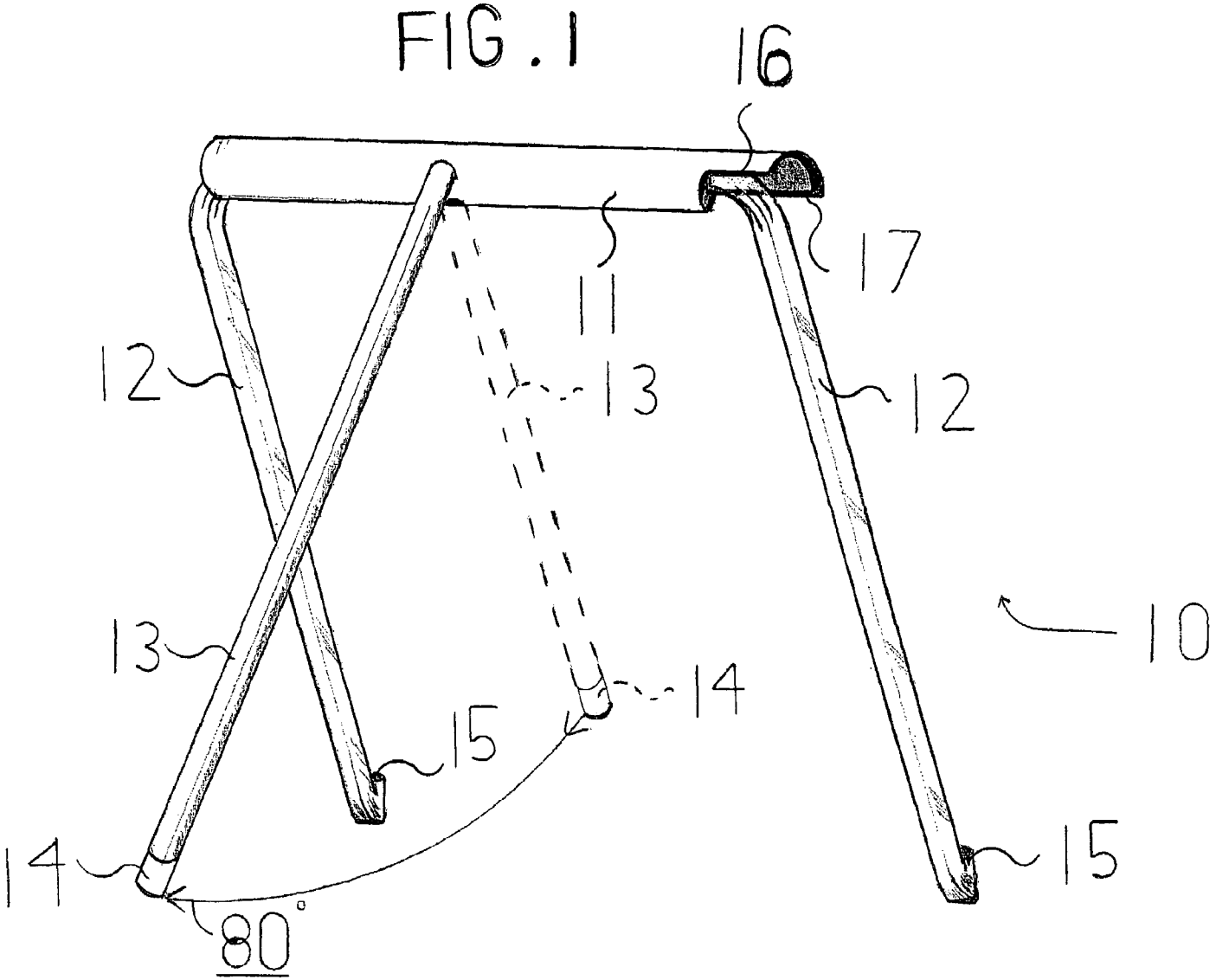
FIG. 1 is a rear elevated view of the overall arrangement of the bookstand in the open position according to the present invention.

10 the bookstand
11 pivotably hollow cylindrical locking mechanism
12 bookstand supporting arms (one piece interconnected through 11)
13 rear supporting arm
14 surface-end-cap
15 curved gripping supports
16 closed locking edge of the pivotably hollow cylindrical locking mechanism
17 open locking edge of the pivotably hollow cylindrical locking mechanism

DETAILED DESCRIPTION—FIGS. 1 THROUGH 4

Figure 3:
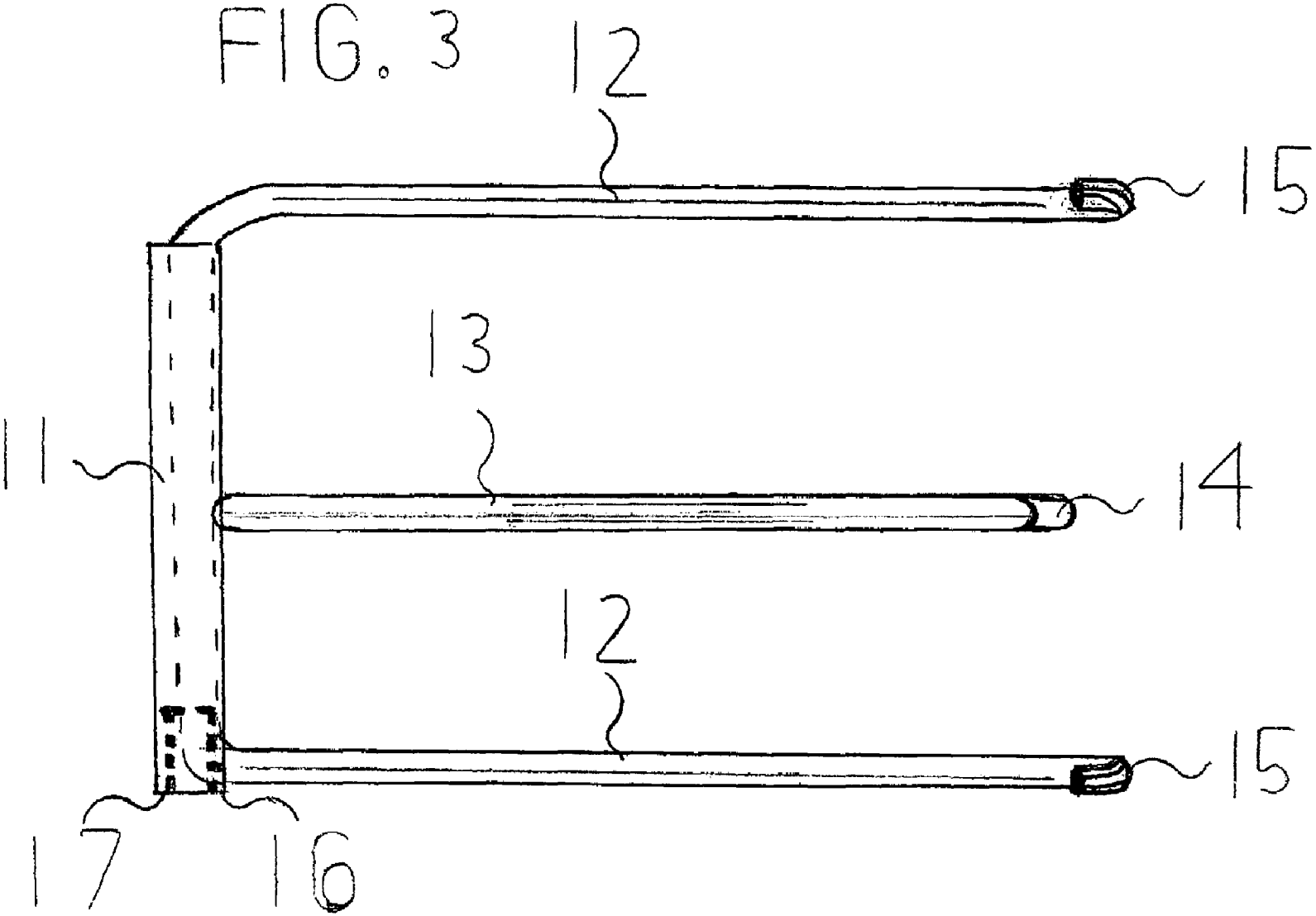
FIG. 3 is a top view of the bookstand laying flat in a folded, collapsed position with all three supporting arms parallel to the other.

A preferred embodiment of the bookstand of the present invention is illustrated in FIG. 1 (Elevated rear view). FIG. 1 illustrates the bookstand 10 in the open position with the rear supporting arm swinging approximately 80 degrees in a clockwise rotation Additionally, FIG. 1, illustrates the said hollow cylindrical locking mechanism's (11) locking end, extending past one of the supporting arms 12. FIG. 3, also provides a collapsed view of the hollow cylindrical locking mechanism 11 extending past one of the said support arm 12, providing a two stop rotational hollow locking mechanism, locking against the front edge of the said support arm when the said bookstand is in an open position and against the rear of said support arm when the said bookstand is in a closed position, front means viewing the said bookstand in an open operational position.

Bookstand 10 employs two bookstand supporting arms 12 that are formed from one single sold piece. The bookstand supporting arms 12 are extended from the collapsed position and may be comprised of any suitable material. The preferred material is a steel or a metal alloy rod that is capable of being bent during production without breaking, but will maintain its shape under pressure. The ends of the two front bookstand supporting arms 12 that make contact with the surface area are curved gripping supports 15 designed to grip the bottom edge of the reading material. The curved gripping supports 15 are bent at an approximate angle of 120 degrees relative to the straight position of bookstand supporting arms 12. The 120 degree angle allows for the reading material to be securely fix in the curved gripping supports 15.

The rear supporting arm 13 is approximately one third shorter than the bookstand supporting arms 12 and is rigidly affixed to a pivotably hollow cylindrical locking mechanism 11, in a manner to be discussed hereinafter. Referring to FIG. 1, the rear supporting arm 13 rotates to an angle of approximately 80 degrees in a clockwise direction, relative to the bookstand supporting arms 12. The rear supporting arm 13 can be comprised of a similar material to that of 12, but can be made of any material that would support the pressure of the material used on the bookstand 10. The end of the rear supporting arm 13 is affixed with a cover made of a material having a high coefficient of friction, such as rubber, so that the arm doesn't slide along or damage the surface area upon which the bookstand 10 is placed.

Figure 4:
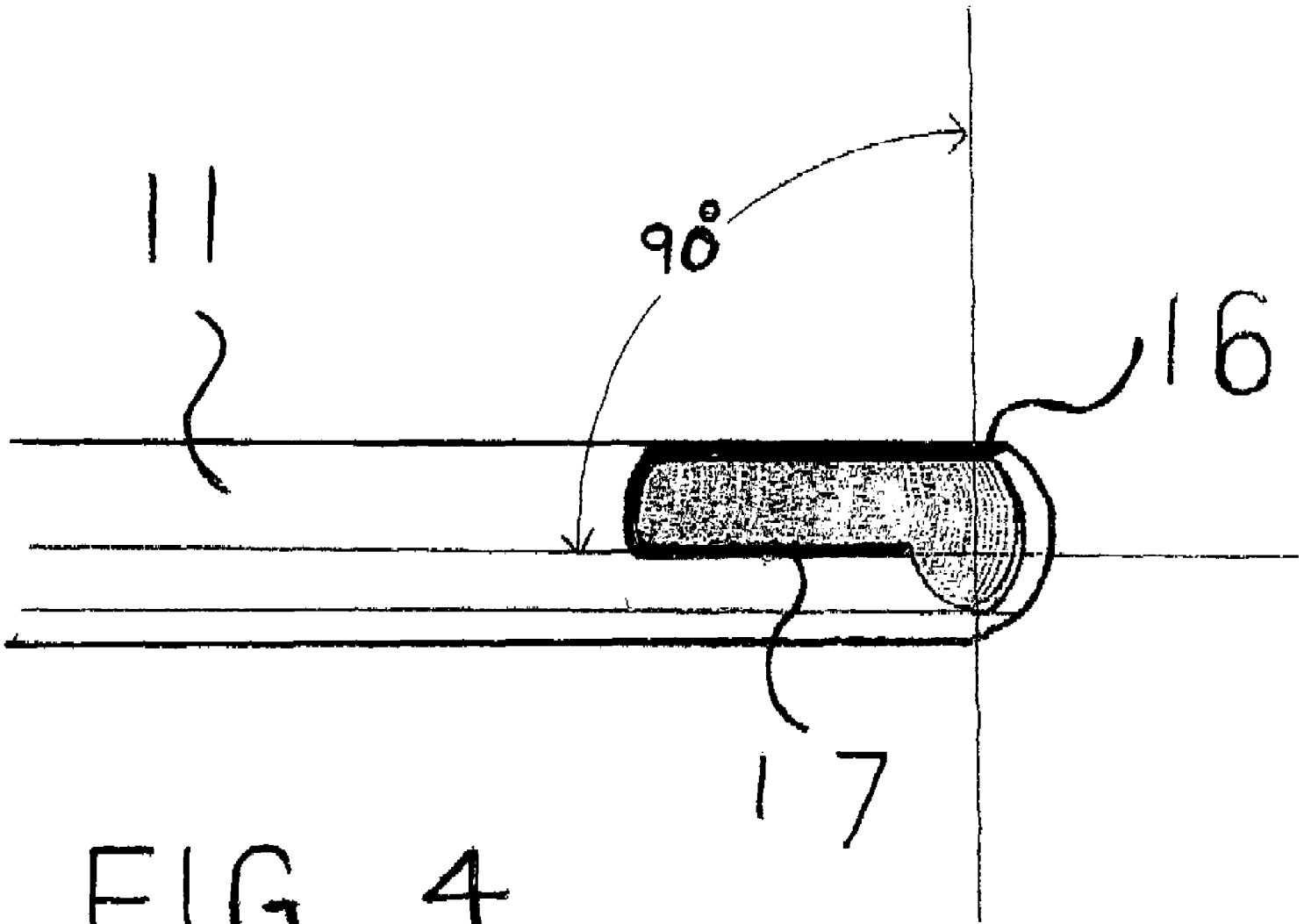
FIG. 4 is an exploded end-view of a pivotably hollow cylindrical locking mechanism (Rear view perspective of bookstand).

FIG. 1 shows a pivotably hollow cylindrical locking mechanism 11 in the open locking edge position 17. The antithesis of 17, shown in FIG. 3 (top view) illustrates the pivotably hollow cylindrical locking mechanism in the closed locking edge position 16. FIG. 4 illustrates an exploded view of the pivotably hollow cylindrical locking mechanism 11, showing the longitudinal groove made in one end of the pivotably hollow cylindrical that enables the bookstand 10 to lock in an open or closed position. When the hollow cylindrical locking mechanism 11 is in the closed locking edge position 16, the locking edge 16 is in contact with the rear of the bookstand supporting arms 12. The material used for the hollow cylindrical locking mechanism 11 must be made of a hollow cylindrical type material with an inside diameter larger than the outside diameter of the bookstand supporting arms 12, and which the bookstand supporting arms 12 can pass through 11 easily prior to bending during production. Material comprised of the pivotably hollow cylindrical locking mechanism 11 should be of a metal or acrylic material that can maintain its shape under pressure.

Figure 2:
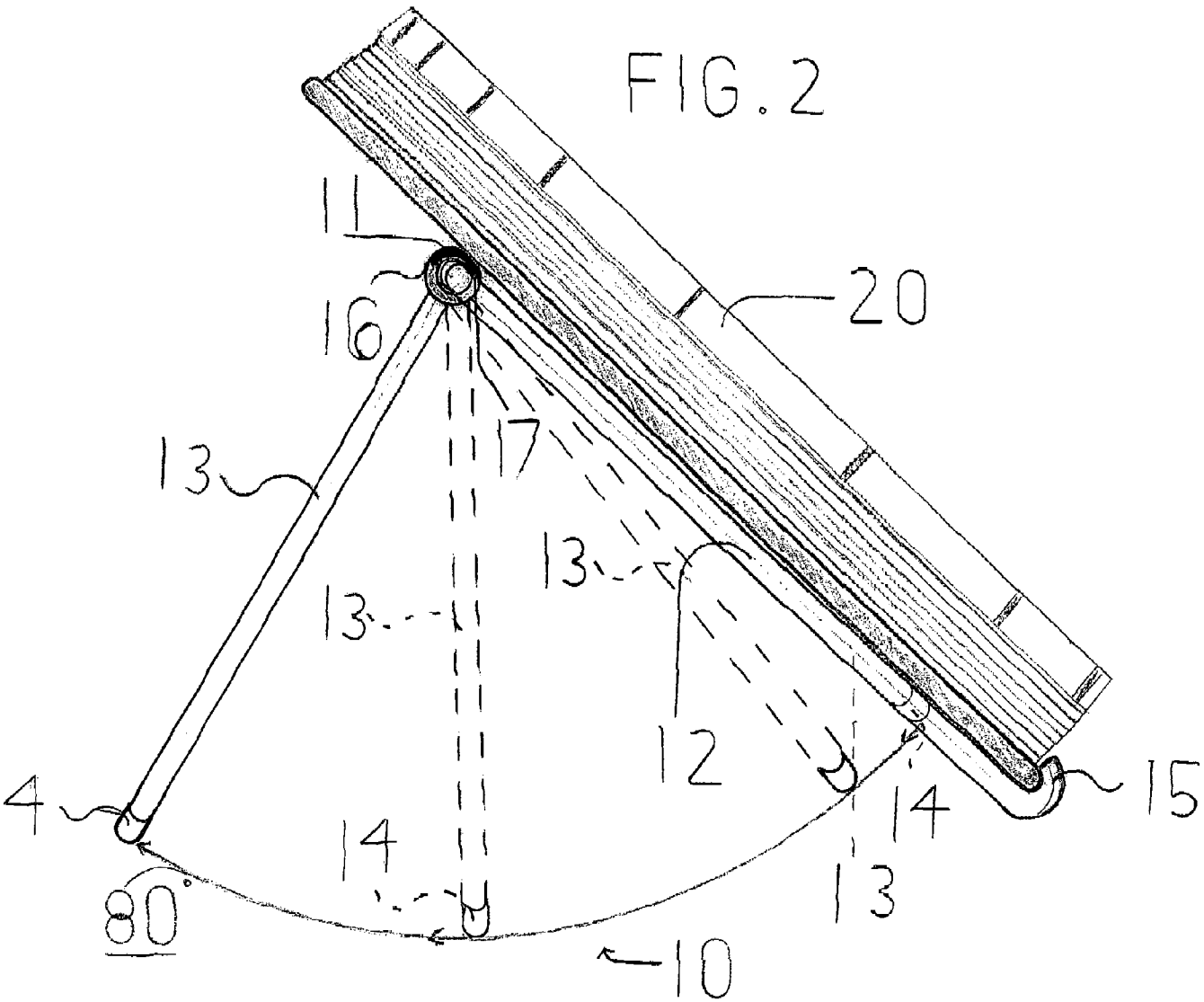
FIG. 2 is a side view of the bookstand illustrating the stand being placed at an angle as the center rear support arm swings out 80 degrees to support the stand and reading material.

As seen in FIG. 2 the rear supporting arm 13 is shown from the closed locking edge position 16 to the final open locking edge position 17, extended and supporting a text book 20. The stability of the open locking edge position 17 generally prevents the user from having to readjust the reading material even if the bookstand is bumped or jarred.

When not in use, the bookstand 10 would normally be stored in the closed compact position FIG. 3 and normally be thin enough to be tucked within a medium sized text book with the curved gripping supports 15 placed outside so as to have the book partial closed over the bookstand 10.

There are a number of configurations that can be made with regard to the closed locking edge 16 and open locking edge 17 of the rotational hollow cylindrical locking mechanism 11. The locking edges may vary in degrees depending on the amount of material removed from the end of the rotational hollow cylindrical locking mechanism In the drawings and specifications, there have been disclosed typical preferred embodiments of the invention, and although specific terms have been employed, they have been used in generic and descriptive sense only and not for purposes of limitation, the scope of the invention will be set forth in the claims.

From the description above, a number of advantages of my bookstand become evident:

(a) A stable bookstand compact, efficient, convenient, simple and easily used.

(b) Manufacturing will be inexpensive to produce.

(c) All purpose bookstand with only one movable part.

(d) Easily transportable and light in weight.

CONCLUSION, RAMIFICATIONS AND SCOPE

Accordingly, the reader will see that the bookstand of this invention can be used to support reading and study materials in a comfortable, convenient manner and can be used without prior or post assembly. Furthermore, the bookstand has the additional advantages in that it remains stable if bumped, due to the low center of gravity it does not require assembly before use or disassembly after use it can be collapsed to a thin position relative to an average text book it can be used in confined areas it is all inclusive, thus no small parts to lose rendering the bookstand inoperative Although the description above contains may specificities, these should not be construed as limiting the scope of the invention but as merely providing illustrations of some of the presently preferred embodiments of this invention. For example, the bookstand can have other shapes, such as circular, oval, trapezoidal, etc.; the rotational hollow cylindrical locking mechanism may also have various grooved edge design in order to lock the bookstand in a number of reclined positions.

Thus the scope of the invention should be determined by the appended claims and their legal equivalents, rather than by the examples given.

I claim:

1. A bookstand for holding hard back books in an angled position for the purpose of study, the bookstand comprising:

a cylindrical tube having opposite first and second openings;

a rod having first and second ends whereby said rod is inserted through the cylindrical tube, said rod forms an U-shape side support arms that extends out of the ends of said cylindrical tube equal distance and said rod first and second ends form a curved shape to hold the back binding of a book in an open position, whereby said back binding of a book is supported against the said U-shape support arms and said cylindrical tube;

a straight rod permanently attached at equal distance from said cylindrical tube ends forming a T-shaped whereby said straight rod forms a rear support arm for said bookstand in the open position for study, wherein one opening end of the cylindrical tube has an amount of material removed in the form of a U-shape along the length of the cylindrical tube defining a hollow locking mechanism whereby one of the two rod side support arms bears against in said U-shape hollow locking mechanism allowing a limited 80-degree rotation of said T-shape from the said side support arms.

* * * * *